US011238784B1

(12) United States Patent
Zhou

(10) Patent No.: US 11,238,784 B1
(45) Date of Patent: Feb. 1, 2022

(54) PIXEL CIRCUIT AND DISPLAY PANEL

(71) Applicant: WUHAN CHINA STAR OPTOELECTRONICS TECHNOLOGY CO., LTD., Wuhan (CN)

(72) Inventor: Yongxiang Zhou, Wuhan (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 17/051,778

(22) PCT Filed: Sep. 11, 2020

(86) PCT No.: PCT/CN2020/114778

§ 371 (c)(1),
(2) Date: Oct. 30, 2020

(30) Foreign Application Priority Data

Aug. 27, 2020 (CN) ..... 202010881106.2

(51) Int. Cl.
*G09G 5/00* (2006.01)
*G09G 3/32* (2016.01)

(52) U.S. Cl.
CPC ..... *G09G 3/32* (2013.01); *G09G 2330/02* (2013.01)

(58) Field of Classification Search
CPC ..... G09G 3/32; G09G 3/3233; G09G 3/3241; G09G 3/325; G09G 3/3258; G09G 2330/02; G09G 2330/021
See application file for complete search history.

(56) References Cited

U.S. PATENT DOCUMENTS

| | | | | |
|---|---|---|---|---|
| 8,049,684 | B2 * | 11/2011 | Kim | G09G 3/3291 345/76 |
| 8,232,933 | B2 * | 7/2012 | Kim | G09G 3/3233 345/76 |
| 9,349,314 | B2 * | 5/2016 | Park | G09G 3/3233 |
| 9,734,763 | B2 * | 8/2017 | Sun | G09G 3/3291 |
| 10,733,933 | B2 * | 8/2020 | Gao | G09G 3/3233 |
| 2006/0186822 | A1 * | 8/2006 | Park | G09G 3/3233 315/169.3 |
| 2007/0118781 | A1 * | 5/2007 | Kim | G09G 3/3291 714/727 |

FOREIGN PATENT DOCUMENTS

| | | | |
|---|---|---|---|
| CN | 1553421 | A | 12/2004 |
| CN | 1700287 | A | 11/2005 |
| CN | 201177956 | Y | 1/2009 |
| CN | 103927991 | A | 7/2014 |
| CN | 107342043 | A | 11/2017 |
| CN | 109410841 | A | 3/2019 |
| EP | 2157562 | A2 | 2/2010 |
| JP | 2003022049 | A | 1/2003 |

* cited by examiner

*Primary Examiner* — Vijay Shankar
(74) *Attorney, Agent, or Firm* — PV IP PC; Wei Te Chung; Ude Lu

(57) ABSTRACT

A pixel circuit and a display panel are provided, which include a first driving transistor, a second driving transistor, a first switching transistor, and a second switching transistor. By controlling the first driving transistor and the second driving transistor to work alternately by the first switching transistor and the second switching transistor, work period of the first driving transistor and/or the second driving transistor can be reduced, being able to improve stability of the driving transistors.

20 Claims, 3 Drawing Sheets

PIXEL CIRCUIT AND DISPLAY PANEL

This application is a Notional Phase of PCT Patent Application No. PCT/CN2020/114778 having international filing date of Sep. 11, 2020, which claims priority to Chinese Patent Application with the application No. 202010881106.2 filed on Aug. 27, 2020 with the National Intellectual Property Administration, the disclosure of which is incorporated by reference in the present application in its entirety.

FIELD OF INVENTION

The present disclosure relates to the field of display technology, and particularly relates to the field of in-plane driving technology, which specifically relates to a pixel circuit and a display panel.

BACKGROUND OF INVENTION

Currently, with rapid development of science and technology, display panels are increasingly being used in work and life. Therefore, people's requirements on display panels are increasingly higher. Compared to micro light emitting diodes (micro-LEDs), mini light emitting diodes (mini-LEDs) have unique advantages such as high contrast, good stability, and simpler processes, gradually receiving more and more widespread attention.

However, the mini-LEDs need large electric current. If driving thin film transistors (TFTs) endure a working environment with large electric current for long-term, their stability can be poor, thereby easily causing problems such as unevenness display or even display failure.

SUMMARY OF INVENTION

The present disclosure provides a pixel circuit and a display panel to solve a problem of poor stability incurred by the driving transistors in pixel circuits being in a long-term working state.

On one aspect, the present disclosure provides a pixel circuit, including a first driving transistor, a second driving transistor, a first switching transistor, and a second switching transistor. The first driving transistor is coupled in series with a light emitting circuit constituted by a first power supply terminal of a first power supply signal and a second power supply terminal of a second power supply signal and is configured to control an electric current flow through the light emitting circuit. The second driving transistor is parallelly connected to the first driving transistor and is coupled in series with the light emitting circuit, and is configured to control the electric current flow through the light emitting circuit. An output terminal of the first switching transistor is connected to a control terminal of the first driving transistor, and the first driving transistor is configured to control the first driving transistor according to a first control signal. An output terminal of the second switching transistor is connected to a control terminal of the second driving transistor, and the second switching transistor controls the second driving transistor according to a second control signal. Furthermore, the first driving transistor and the second driving transistor works alternately.

On the basis of the first aspect, in a first embodiment of the first aspect, the pixel circuit further includes a writing transistor. An output terminal of the writing transistor and the output terminal of the first driving transistor are connected to the output terminal of the second driving transistor, and the writing transistor controls a data signal to write into the pixel circuit according to a first scanning signal.

On the basis of the first embodiment of the first aspect, in a second embodiment of the first aspect, the pixel circuit further includes a compensation transistor. An input terminal of the compensation transistor and an input terminal of the first driving transistor are connected to an input terminal of the second driving transistor, an output terminal of the compensation transistor and an input terminal of the first switching transistor are connected to an input terminal of the second switching transistor, and a control terminal of the compensation transistor is configured to receive the first scanning signal.

On the basis of the second embodiment of the first aspect, in a third embodiment of the first aspect, the pixel circuit further includes a storage capacitor. A first terminal of the storage capacitor is connected to the output terminal of the compensation transistor, and a second terminal of the storage capacitor is connected to the second power supply terminal of the second power supply signal.

On the basis of the third embodiment of the first aspect, in a fourth embodiment of the first aspect, the pixel circuit further includes an initialization transistor. An output terminal of the initialization transistor is connected to the first terminal of the storage capacitor, and the initialization transistor initializes an electric potential of the first terminal of the storage capacitor to an electric potential of an initialized voltage signal according to a second scanning signal.

On the basis of the fourth embodiment of the first aspect, in a fifth embodiment of the first aspect, the pixel circuit further includes a first light emitting control transistor and a second light emitting control transistor. The first light emitting control transistor is coupled in series with the light emitting circuit, and an output terminal of the first light emitting control transistor and the input terminal of the first driving transistor are connected to the input terminal of the second driving transistor, and the first light emitting control transistor is configured to switch the light emitting circuit according to a light emitting control signal. The second light emitting control transistor is coupled in series with the light emitting circuit, and an input terminal of the second light emitting control transistor and the output terminal of the first driving transistor are connected to the output terminal of the second driving transistor, and the second light emitting control transistor is configured to switch the light emitting circuit according to the light emitting control signal.

On the basis of the fifth embodiment of the first aspect, in a sixth embodiment of the first aspect, the pixel circuit further includes a light emitting device. The light emitting device is coupled in series with the light emitting circuit, and an input terminal of the light emitting device is connected to the first power supply terminal of the first power supply signal, or the output terminal of the light emitting device is connected to the second power supply terminal of the second power supply signal.

On the basis of any embodiment of the first aspect, in a seventh embodiment of the first aspect, an electric potential of the first power supply signal is greater than an electric potential of the second power supply signal.

On the basis of any embodiment of the first aspect, in an eighth embodiment of the first aspect, at least one of the first driving transistor, the second driving transistor, the first switching transistor, the second switching transistor, the writing transistor, the compensation transistor, the initialization transistor, the first light emitting control transistor, or the second light emitting control transistor is an N-type thin film transistor.

On a second aspect, the present disclosure provides a display panel, including the pixel circuit of any embodiment mentioned above.

By controlling the first driving transistor and the second driving transistor to work alternately by the first switching transistor and the second switching transistor, the pixel circuit and the display panel provided by the present disclosure can reduce work period of the first driving transistor and/or the second driving transistor, being able to improve stability of the driving transistors, thereby enhancing reliability and service life of the pixel circuit and the display panel.

DETAILED DESCRIPTION OF PREFERRED EMBODIMENTS

For making the purposes, technical solutions and effects of the present disclosure be clearer and more definite, the present disclosure will be further described in detail below. It should be understood that the specific embodiments described herein are merely for explaining the present disclosure and are not intended to limit the present disclosure.

Figure 1:
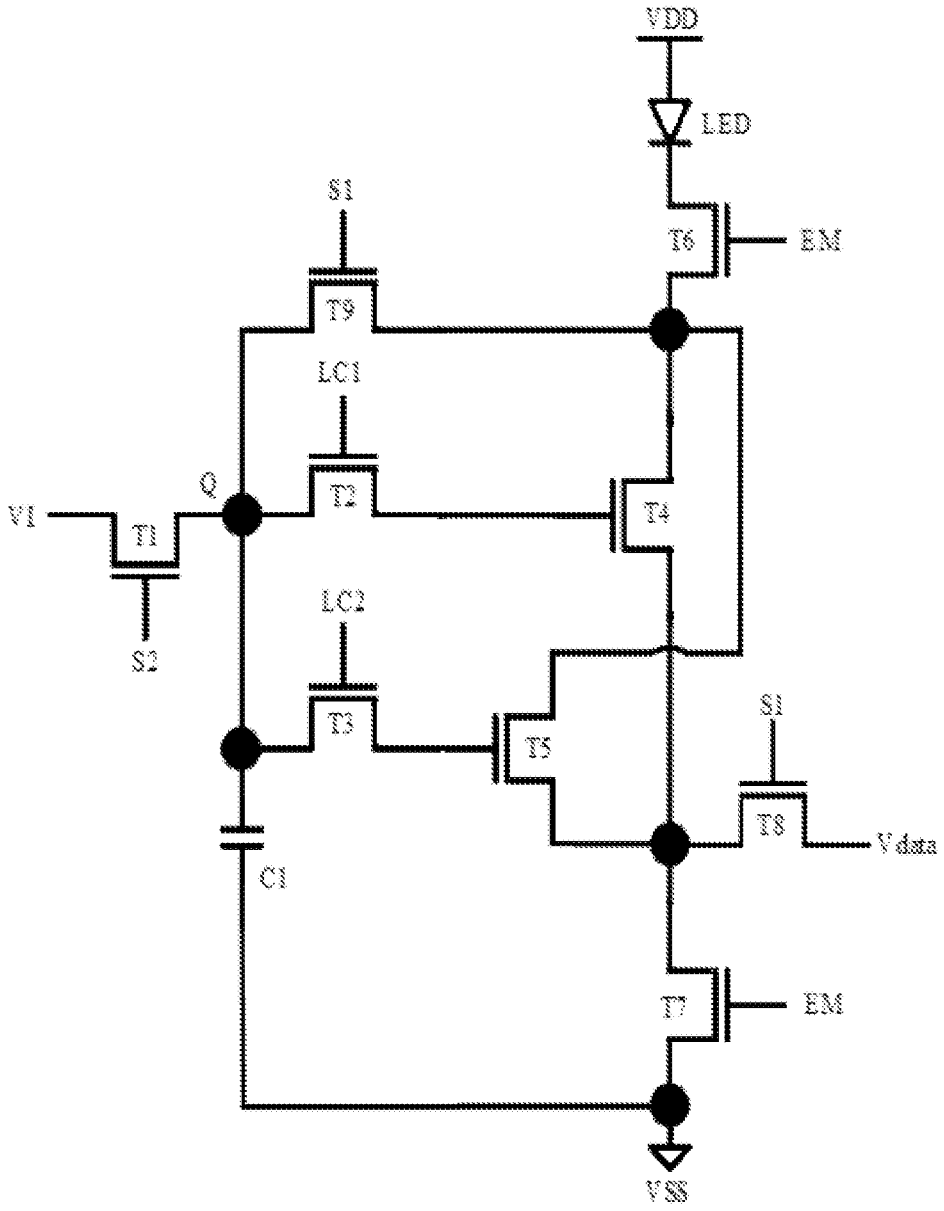
FIG. 1 is a first structural schematic diagram of a pixel circuit provided by one embodiment of the present disclosure.
Figure 2:
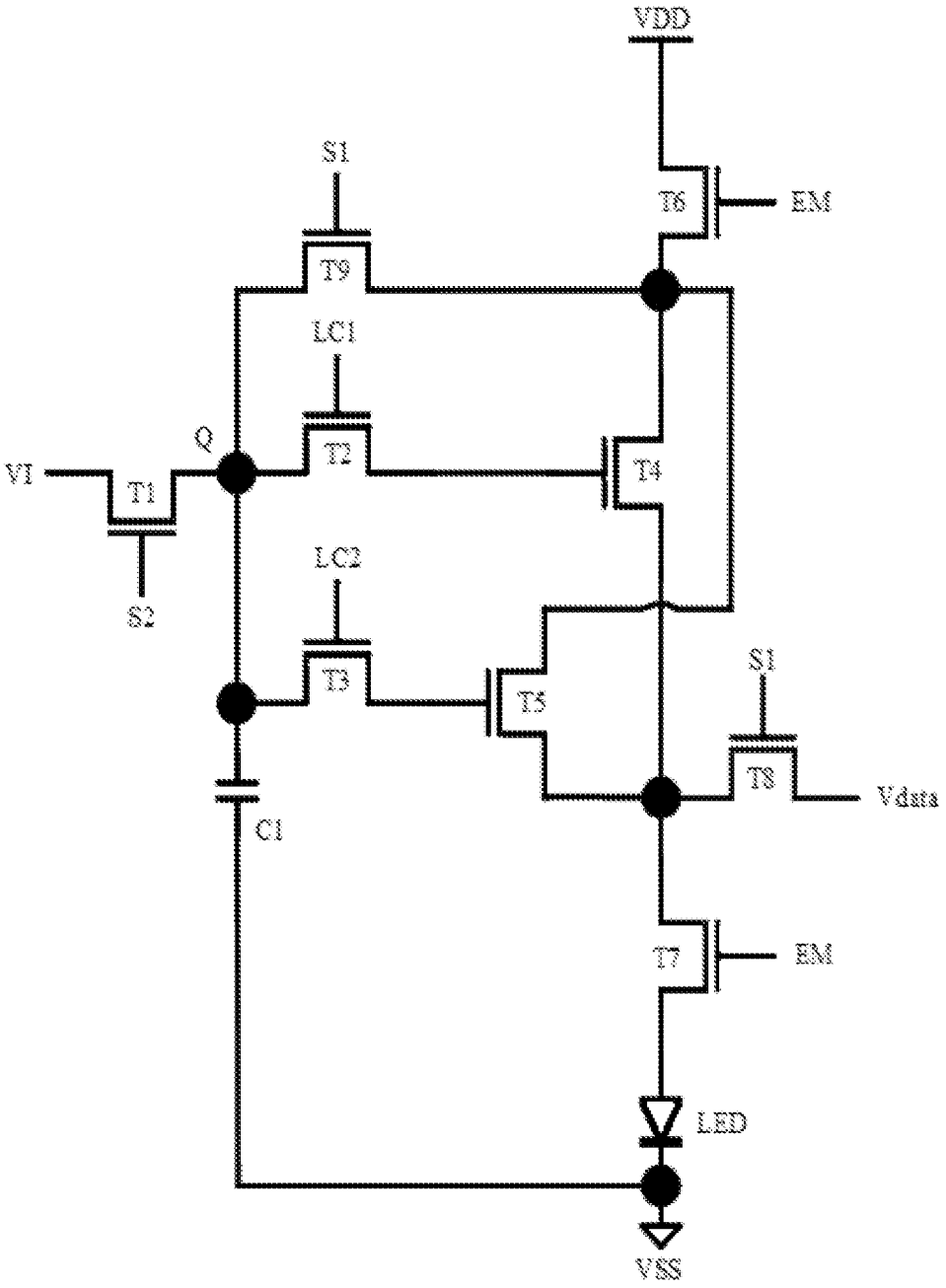
FIG. 2 is a second structural schematic diagram of the pixel circuit provided by one embodiment of the present disclosure.

As illustrated in FIG. 1 or FIG. 2, this embodiment provides a pixel circuit, including a first driving transistor T4, a second driving transistor T5, a first switching transistor T2, and a second switching transistor T3. The first driving transistor T4 is coupled in series with a light emitting circuit constituted by a first power supply terminal of a first power supply signal VDD and a second power supply terminal of a second power supply signal VSS and is configured to control an electric current flow through the light emitting circuit. The second driving transistor T5 is parallelly connected to the first driving transistor T4 and is coupled in series with the light emitting circuit, and is configured to control the electric current flow through the light emitting circuit. An output terminal of the first switching transistor T2 is connected to a control terminal of the first driving transistor T4, and the first driving transistor T2 is configured to control the first driving transistor T4 according to a first control signal LC1. An output terminal of the second switching transistor T3 is connected to a control terminal of the second driving transistor T5, and the second switching transistor T3 controls the second driving transistor T5 according to a second control signal LC2. Furthermore, the first driving transistor T4 and the second driving transistor T5 works alternately.

Furthermore, in this embodiment, the first switching transistor T2 and the second switching transistor T3 can be but are not limited to same-type transistors, for example, they can be N-channel type thin film transistors, and can also be P-channel type thin film transistors. Correspondingly, working periods of the first control signal LC1, the second control signal LC2 alternate or at least partially overlap with each other.

When the first switching transistor T2 and the second switching transistor T3 are the N-channel type thin film transistors, the working periods of the first control signal LC1 and the second control signal LC2 are in high-level continuing periods thereof. Therefore, it can be understood that when the working periods of the first control signal LC1 and the second control signal LC2 work in an alternate manner, falling edge of the first control signal LC1 and rising edge of the second control signal LC2 can be superposed or can be at a same time, or the rising edge of the second control signal LC2 can also be located between a rising edge and the falling edge of the first control signal LC1.

When the first switching transistor T2 and the second switching transistor T3 are the P-channel type thin film transistors, the working periods of the first control signal LC1 and the second control signal LC2 are in low-level continuing periods thereof. Therefore, it can be understood that when the working periods of the first control signal LC1 and the second control signal LC2 work in an alternate manner, rising edge of the first control signal LC1 and falling edge of the second control signal LC2 can be superposed or can be at a same time, or the falling edge of the second control signal LC2 can also be located between a falling edge and the rising edge of the first control signal LC1.

As same, the first switching transistor T2 can be the N-channel type thin film transistor, and the second switching transistor T3 can be the P-channel type thin film transistor; or the first switching transistor T2 can be the P-channel type thin film transistor, and the second switching transistor T3 can be the N-channel type thin film transistor. In this way, any one of the first control signal LC1 or second control signal LC2 can also be used, for example, a control terminal of the first switching transistor T2 and a control terminal of the second switching transistor T3 are configured to receive the first control signal LC1 or second control signal LC2, at this time, when the first control signal LC1 or second control signal LC2 is in an high electric potential state, the first switching transistor T2 is turned on, and the second switching transistor T3 is turned off; or the first switching transistor T2 is turned off, and the second switching transistor T3 is turned on. When the first control signal LC1 or second control signal LC2 is in a low electric potential state, the first switching transistor T2 is turned off, and the second switching transistor T3 is turned on; or the first switching transistor T2 is turned on, and the second switching transistor T3 is turned off.

From the above, the first switching transistor T2 can control whether the control terminal of the first driving transistor T4 receives the corresponding driving signal, and the second switching transistor T3 can control whether the control terminal of the second driving transistor T5 receives the corresponding driving signal, so that the first driving transistor T4 and the second driving transistor T5 can work alternately, making the driving transistor able to have corresponding recesses by turns, which is favorable for regaining electric characteristics of the driving transistors, thereby improving working stability of the driving transistors, and hence improving service life of the entire driving circuit and enhancing reliability thereof.

In summary, by controlling the first driving transistor T4 and the second driving transistor T5 to work alternately by the first switching transistor T2 and the second switching transistor T3, the pixel circuit provided by the embodiments of the present disclosure can improve stability of the driving transistors, thereby enhancing reliability and service life of the pixel circuit and the display panel.

As illustrated in FIG. 1 or FIG. 2, in one embodiment, the pixel circuit further includes a writing transistor T8. An output terminal of the writing transistor T8 and the output terminal of the first driving transistor T4 are connected to the output terminal of the second driving transistor T5, and the writing transistor T8 controls a data signal Vdata to write into the pixel circuit according to a first scanning signal S1.

As illustrated in FIG. 1 or FIG. 2, in one embodiment, the pixel circuit further includes a compensation transistor T9. An input terminal of the compensation transistor T9 and an input terminal of the first driving transistor T4 are connected to an input terminal of the second driving transistor T5, an output terminal of the compensation transistor T9 and an input terminal of the first switching transistor T2 are connected to an input terminal of the second switching transistor T3, and a control terminal of the compensation transistor T9 is configured to receive the first scanning signal S1.

As illustrated in FIG. 1 or FIG. 2, in one embodiment, the pixel circuit further includes a storage capacitor C1. A first terminal of the storage capacitor C1 is connected to the output terminal of the compensation transistor T9, and a second terminal of the storage capacitor C1 is connected to the second power supply terminal of the second power supply signal VSS.

As illustrated in FIG. 1 or FIG. 2, in one embodiment, the pixel circuit further includes an initialization transistor T1. An output terminal of the initialization transistor T1 is connected to the first terminal of the storage capacitor C1, and the initialization transistor T1 initializes an electric potential of the first terminal of the storage capacitor C1 to an electric potential of an initialized voltage signal VI according to a second scanning signal S2.

As illustrated in FIG. 1 or FIG. 2, in one embodiment, the pixel circuit further includes a first light emitting control transistor T6 and a second light emitting control transistor T7. The first light emitting control transistor T6 is coupled in series with the light emitting circuit. An output terminal of the first light emitting control transistor T6 and the input terminal of the first driving transistor T4 are connected to the input terminal of the second driving transistor T5, and the first light emitting control transistor T6 is configured to switch the light emitting circuit according to a light emitting control signal EM. The second light emitting control transistor T7 is coupled in series with the light emitting circuit. An input terminal of the second light emitting control transistor T7 and the output terminal of the first driving transistor T4 are connected to the output terminal of the second driving transistor T5, and the second light emitting control transistor T7 is configured to switch the light emitting circuit according to the light emitting control signal EM.

In one embodiment, the pixel circuit further includes a light emitting device LED. The light emitting device LED is coupled in series with the light emitting circuit, and an input terminal of the light emitting device LED is connected to the first power supply terminal of the first power supply signal VDD, or the output terminal of the light emitting device LED is connected to the second power supply terminal of the second power supply signal VSS.

As illustrated in FIG. 1, it should be noted that the input terminal of the light emitting device LED can be connected to the first power supply terminal of the first power supply signal VDD, and the output terminal of the light emitting device LED can be connected to the input terminal of the first light emitting control transistor T6. Also, it can be illustrated in FIG. 2, the input terminal of the light emitting device LED can be connected to the output terminal of the second light emitting control transistor T7, and the output terminal of the light emitting device LED can be connected to the second power supply terminal of the second power supply signal VSS.

Furthermore, the light emitting device LED of this embodiment can be any one of mini light emitting diodes (mini-LEDs), micro light emitting diodes (micro-LEDs), or organic light emitting diodes (OLEDs).

In one embodiment, an electric potential of the first power supply signal VDD is greater than an electric potential of the second power supply signal VSS.

In one embodiment, at least one of the first driving transistor T4, the second driving transistor T5, the first switching transistor T2, the second switching transistor T3, the writing transistor T8, the compensation transistor T9, the initialization transistor T1, the first light emitting control transistor T6, or the second light emitting control transistor T7 is the N-type thin film transistor.

It should be noted that the first control signal LC1 and/or the second control signal LC2 can be but are not limited to clock signals with relative low frequency or clock signals with low frequency.

It should be noted that the input terminals of corresponding transistors described in the embodiments of the present disclosure can be drain electrodes thereof, or can be source electrodes thereof. The output terminals of corresponding transistors described in the embodiments of the present disclosure can be drain electrodes thereof, or can be source electrodes thereof. The control terminals of corresponding transistors described in the embodiments of the present disclosure are gate electrodes thereof.

Figure 3:
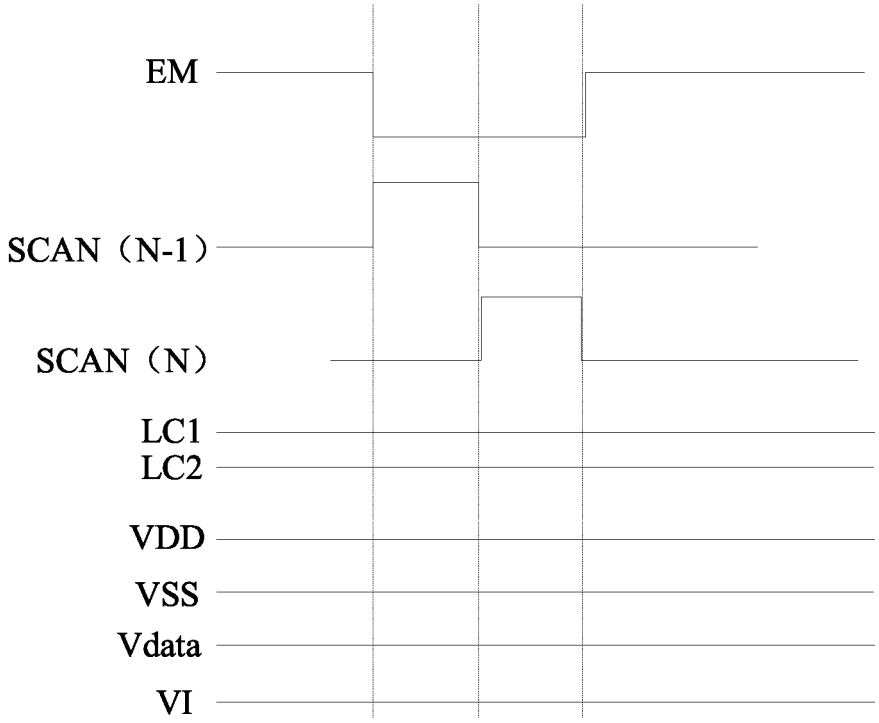
FIG. 3 is a time sequence schematic diagram of the pixel circuit provided by one embodiment of the present disclosure.

As illustrated in FIG. 3, time sequences of the pixel circuits of the two structures provided by this embodiment can include following stages.

A reset stage, wherein when an N−1 stage scanning signal SCAN (N−1) changes to a high electric potential from a low electric potential, the initialization transistor T1 is turned on, then an initialized voltage signal V1 can be written into a node Q to realize reset.

Furthermore, the first control signal LC2 and the second control signal LC2 are low frequency control signals with opposite phase, one of them is high electric potential (VGH), and another is low electric potential (VGL). Therefore, one of the first switching transistor T2 and the second switching transistor T3 is in a turning-on state, and another is in a turning-off state. Controlling the first driving transistor T4 or the second driving transistor T5 to work by the first control signal LC1 and the second control signal LC2, in this way, the first driving transistor T4 and the second driving transistor T5 can work in a half time and can rest in another half, making electric characteristics of corresponding driving transistor able to recover, thereby improving stability and reliability.

A compensation stage, wherein when an N stage scanning signal SCAN (N) changes to a high electric potential from a low electric potential, the writing transistor T8 and the compensation transistor T9 are turned on, then the data signal Vdata is written into the node Q, and compensation of a threshold voltage (Vth) for the corresponding driving transistor is completed simultaneously.

A light emitting stage, wherein the light emitting control signal EM changes to high electric potential from the low electric potential, the first light emitting control transistor T6 and the second light emitting control transistor T7 are turned on, and the light emitting device LED starts to emit light.

It should be noted that the first scanning signal S1 can be but is not limited to the Nth stage scanning signal SCAN (N), it can also be other square wave signals. It should be noted that the second scanning signal S2 can be but is not limited to the N−1th stage scanning signal SCAN (N−1), it can also be other square wave signals.

It should be noted that the first power supply signal VDD can be a direct current high electric potential signal, and the second power supply signal VSS can be a direct current low electric potential signal.

In one of the embodiments, the present disclosure provides a display panel, including the pixel circuit mentioned in any above embodiments.

It should be noted that when the transistors of the pixel circuit is formed in layer structures of the display panel as film layers, dimensions of the first light emitting control transistor T4 and second light emitting control transistor T5 can be same and are greater than a dimension of the first light emitting control transistor T6 or the second light emitting control transistor T7. Furthermore, the dimension of the first light emitting control transistor can be equal to the dimension of the second light emitting control transistor T7, but it is not limited. The dimension of any transistor of the first switching transistor T2, the second switching transistor T3, the writing transistor T8, the compensation transistor T9, and the initialization transistor T1 is less than the dimension of the first light emitting transistor or the second light emitting transistor.

By controlling the first driving transistor T4 and the second driving transistor T5 to work alternately by the first switching transistor T2 and the second switching transistor T3, the display panel provided by the embodiments of the present disclosure can improve stability of the driving transistors, thereby enhancing reliability and service life of the pixel circuit and the display panel.

It can be understood, that for those of ordinary skill in the art, various other corresponding changes and modifications can be made according to the technical solutions and technical ideas of the present disclosure, and all such changes and modifications are intended to fall within the scope of protection of the claims of the present disclosure.

What is claimed is:

1. A pixel circuit, comprising:

a first driving transistor coupled in series with a light emitting circuit constituted by a first power supply terminal of a first power supply signal and a second power supply terminal of a second power supply signal and configured to control an electric current flow through the light emitting circuit;

a second driving transistor parallelly connected to the first driving transistor and coupled in series with the light emitting circuit and configured to control the electric current flow through the light emitting circuit;

a first switching transistor, wherein an output terminal of the first switching transistor is connected to a control terminal of the first driving transistor, and the first driving transistor is configured to control the first driving transistor according to a first control signal; and a second switching transistor, wherein an output terminal of the second switching transistor is connected to a control terminal of the second driving transistor, and the second switching transistor controls the second driving transistor according to a second control signal, wherein the first control signal is different from the second control signal, and when one of the first driving transistor or the second driving transistor is turned off, another one of the first driving transistor or the second driving transistor is turned on.

2. The pixel circuit as claimed in claim 1, wherein the pixel circuit comprises:

a writing transistor, wherein an output terminal of the writing transistor and the output terminal of the first driving transistor are connected to the output terminal of the second driving transistor, and the writing transistor controls a data signal to write into the pixel circuit according to a first scanning signal.

3. The pixel circuit as claimed in claim 2, wherein the pixel circuit comprises:

a compensation transistor, wherein an input terminal of the compensation transistor and an input terminal of the first driving transistor are connected to an input terminal of the second driving transistor, an output terminal of the compensation transistor and an input terminal of the first switching transistor are connected to an input terminal of the second switching transistor, and a control terminal of the compensation transistor is configured to receive the first scanning signal.

4. The pixel circuit as claimed in claim 3, wherein the pixel circuit comprises:

a storage capacitor, wherein a first terminal of the storage capacitor is connected to the output terminal of the compensation transistor, and a second terminal of the storage capacitor is connected to the second power supply terminal of the second power supply signal.

5. The pixel circuit as claimed in claim 4, wherein the pixel circuit comprises:

an initialization transistor, wherein an output terminal of the initialization transistor is connected to the first terminal of the storage capacitor, and the initialization transistor initializes an electric potential of the first terminal of the storage capacitor to an electric potential of an initialized voltage signal according to a second scanning signal.

6. The pixel circuit as claimed in claim 5, wherein the pixel circuit comprises:

a first light emitting control transistor coupled in series with the light emitting circuit, wherein an output terminal of the first light emitting control transistor and the input terminal of the first driving transistor are connected to the input terminal of the second driving transistor, and the first light emitting control transistor is configured to switch the light emitting circuit according to a light emitting control signal; and a second light emitting control transistor coupled in series with the light emitting circuit, wherein an input terminal of the second light emitting control transistor and the output terminal of the first driving transistor are connected to the output terminal of the second driving transistor, and the second light emitting control transistor is configured to switch the light emitting circuit according to the light emitting control signal.

7. The pixel circuit as claimed in claim 6, wherein the pixel circuit comprises:

a light emitting device, wherein the light emitting device is coupled in series with the light emitting circuit, and an input terminal of the light emitting device is connected to the first power supply terminal of the first power supply signal, or the output terminal of the light emitting device is connected to the second power supply terminal of the second power supply signal.

8. The pixel circuit as claimed in claim 1, wherein an electric potential of the first power supply signal is greater than an electric potential of the second power supply signal.

9. The pixel circuit as claimed in claim 6, wherein at least one of the first driving transistor, the second driving transistor, the first switching transistor, the second switching transistor, the writing transistor, the compensation transistor, the initialization transistor, the first light emitting control transistor, or the second light emitting control transistor is an N-type thin film transistor.

10. A display panel, comprising the pixel circuit as claimed in claim 1.

11. The display panel as claimed in claim 10, wherein a dimension of the first driving transistor and a dimension of the second driving transistor are same, a dimension of the first switching transistor and a dimension of the second switching transistor are same, and the dimension of the first driving transistor is greater than the dimension of the first switching transistor.

12. The display panel as claimed in claim 11, wherein the pixel circuit comprises:

a writing transistor, wherein an output terminal of the writing transistor and the output terminal of the first driving transistor are connected to the output terminal of the second driving transistor, and the writing transistor controls a data signal to write into the pixel circuit according to a first scanning signal.

13. The display panel as claimed in claim 12, wherein the pixel circuit comprises:

a compensation transistor, wherein an input terminal of the compensation transistor and an input terminal of the first driving transistor are connected to an input terminal of the second driving transistor, an output terminal of the compensation transistor and an input terminal of the first switching transistor are connected to an input terminal of the second switching transistor, and a control terminal of the compensation transistor is configured to receive the first scanning signal.

14. The display panel as claimed in claim 13, wherein the pixel circuit comprises:

a storage capacitor, wherein a first terminal of the storage capacitor is connected to the output terminal of the compensation transistor, and a second terminal of the storage capacitor is connected to the second power supply terminal of the second power supply signal.

15. The display panel as claimed in claim 14, wherein the pixel circuit comprises:

an initialization transistor, wherein an output terminal of the initialization transistor is connected to the first terminal of the storage capacitor, and the initialization transistor initializes an electric potential of the first terminal of the storage capacitor to an electric potential of an initialized voltage signal according to a second scanning signal.

16. The display panel as claimed in claim 15, wherein the pixel circuit comprises:

a first light emitting control transistor coupled in series with the light emitting circuit, wherein an output terminal of the first light emitting control transistor and the input terminal of the first driving transistor are connected to the input terminal of the second driving transistor, and the first light emitting control transistor is configured to switch the light emitting circuit according to a light emitting control signal; and a second light emitting control transistor coupled in series with the light emitting circuit, wherein an input terminal of the second light emitting control transistor and the output terminal of the first driving transistor are connected to the output terminal of the second driving transistor, and the second light emitting control transistor is configured to switch the light emitting circuit according to the light emitting control signal.

17. The display panel as claimed in claim 16, wherein the pixel circuit comprises:

a light emitting device, wherein the light emitting device is coupled in series with the light emitting circuit, and an input terminal of the light emitting device is connected to the first power supply terminal of the first power supply signal, or the input terminal of the light emitting device is connected to the second power supply terminal of the second power supply signal.

18. The display panel as claimed in claim 17, wherein an electric potential of the first power supply signal is greater than an electric potential of the second power supply signal.

19. The display panel as claimed in claim 18, wherein at least one of the first driving transistor, the second driving transistor, the first switching transistor, the second switching transistor, the writing transistor, the compensation transistor, the initialization transistor, the first light emitting control transistor, or the second light emitting control transistor is an N-type thin film transistor.

20. The display panel as claimed in claim 16, wherein a dimension of the first light emitting control transistor and a dimension of the second light emitting control transistor are same, the dimension of the first driving transistor is greater than the dimension of the first light emitting control transistor, and the dimension of the first light emitting control transistor is greater than the dimension of the first switching transistor.

* * * * *